United States Patent [19]

Kemp et al.

[11] Patent Number: 4,733,867

[45] Date of Patent: Mar. 29, 1988

[54] FINGER FOOTBALL/FINGER RUGBY GAME

[76] Inventors: Kelvin P. Kemp, 1237 2nd St., Hermosa Beach, Calif. 90254; Kerry E. Kemp, 312 Winnipeg Pl., Long Beach, Calif. 90814

[21] Appl. No.: 941,716

[22] Filed: Dec. 15, 1986

Related U.S. Application Data

[63] Continuation-in-part of Ser. No. 812,078, Dec. 23, 1985, abandoned.

[51] Int. Cl.[4] ..... A63F 7/06

[52] U.S. Cl. ..... 273/94; 273/285; 273/85 R

[58] Field of Search ..... 273/94, 284, 85 R, 247, 273/126 R, 286, 287, 407, 408, 55 D, 285

[56] References Cited

U.S. PATENT DOCUMENTS 1,663,404 1/1927 Hands ..... 273/94 R
4,183,531 1/1980 White ..... 273/247

FOREIGN PATENT DOCUMENTS 555370 8/1943 United Kingdom ..... 273/85 R
1529040 10/1978 United Kingdom ..... 273/126 R

*Primary Examiner*—Richard C. Pinkham
*Assistant Examiner*—Mark S. Graham
*Attorney, Agent, or Firm*—Singer and Singer

[57] ABSTRACT

This invention concerns a table top game capable of being played on a reversible table surface having a football playing field on one side and a rugby playing field on the opposite side. Each game is suitably marked with the necessary markings and preferably contains a green base to simulate the real game. Opposite ends of the game include goal posts that may either be fixed or removable, depending on the wishes of the user. A flexible reversible table surface is also described together with a fixed reversible table surface capable of being played on any supporting surface including the floor. Each of the games is played with a miniature ball that is kicked off by a flip of a player's finger.

1 Claim, 10 Drawing Figures

FIG. 1
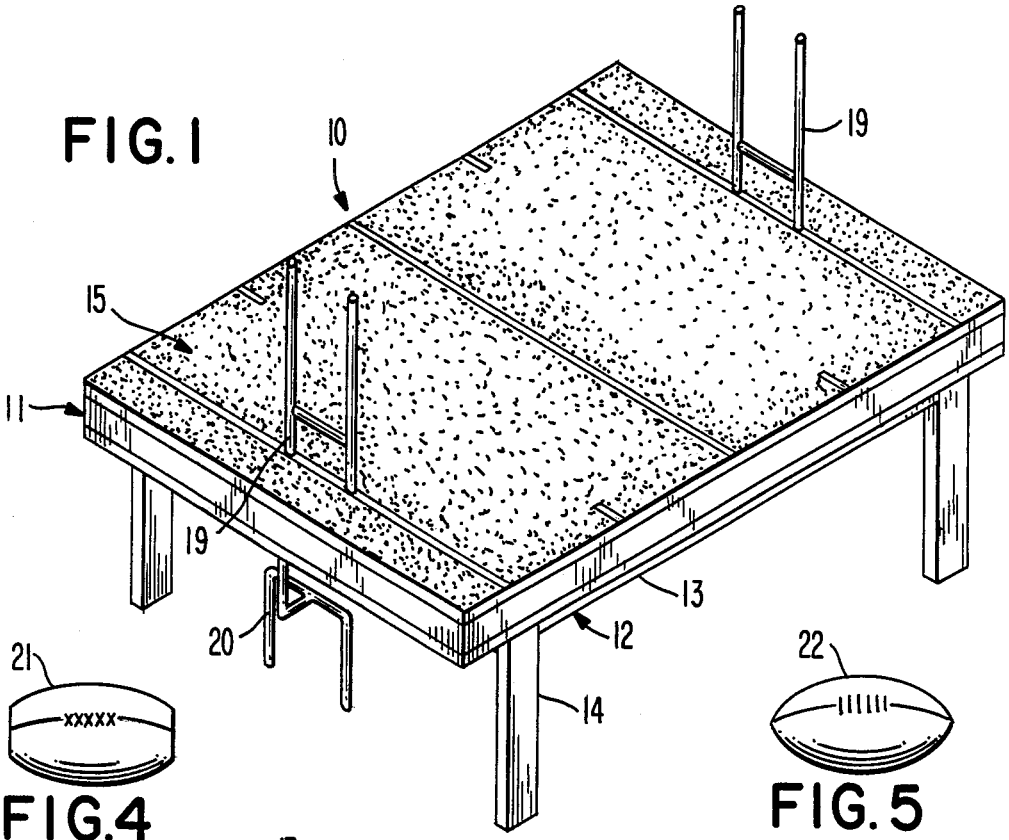
FIG. 4
FIG. 5
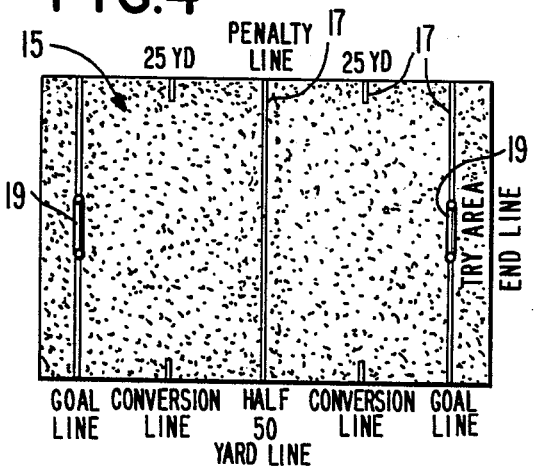
FIG. 2
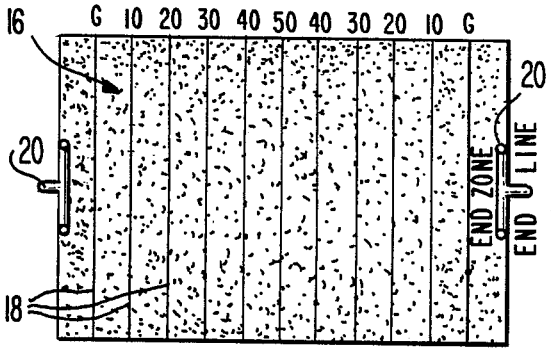
FIG. 3
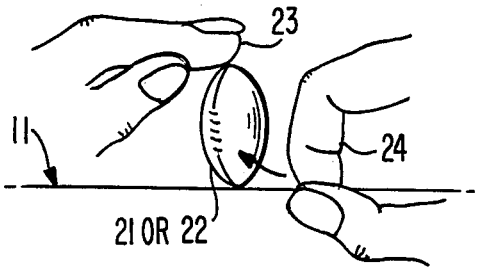
FIG. 6

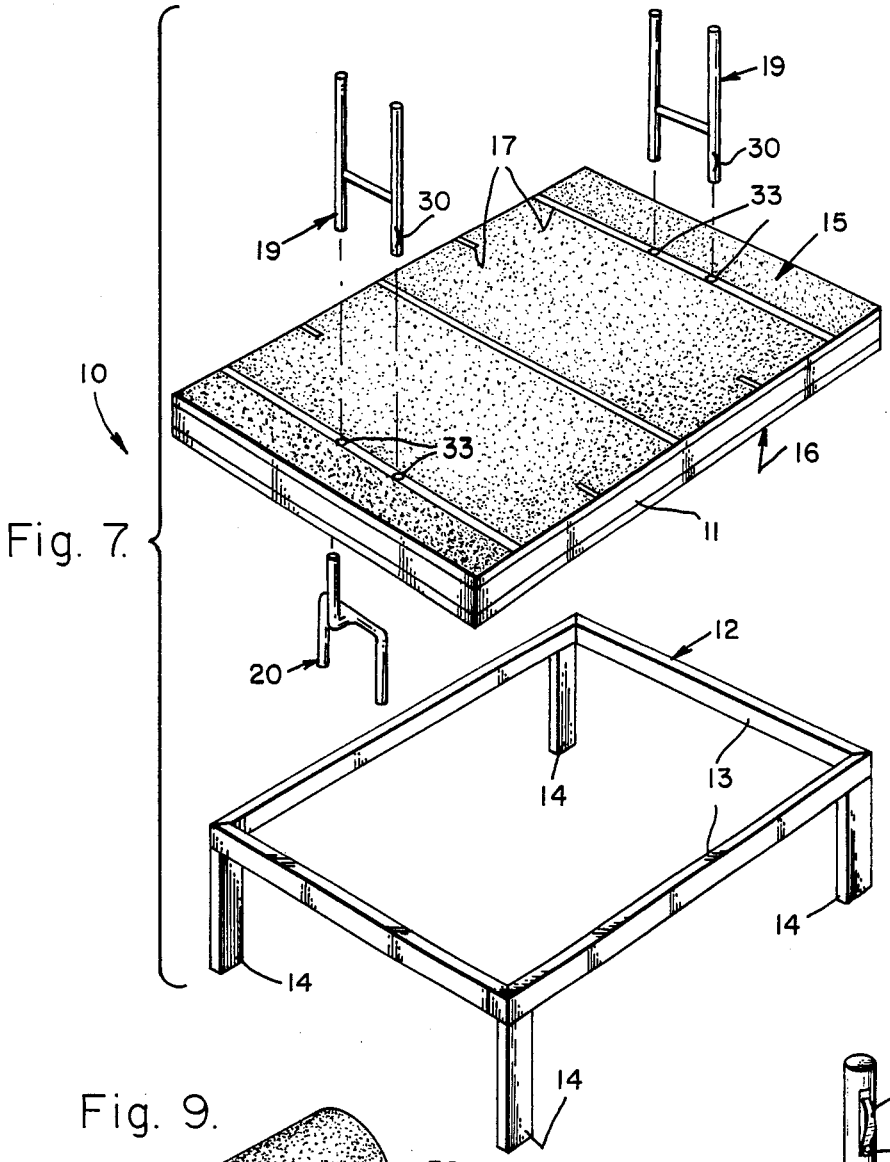
Fig. 7.
Fig. 8
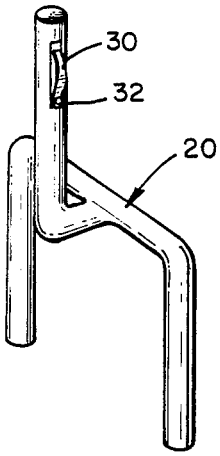
Fig. 9.
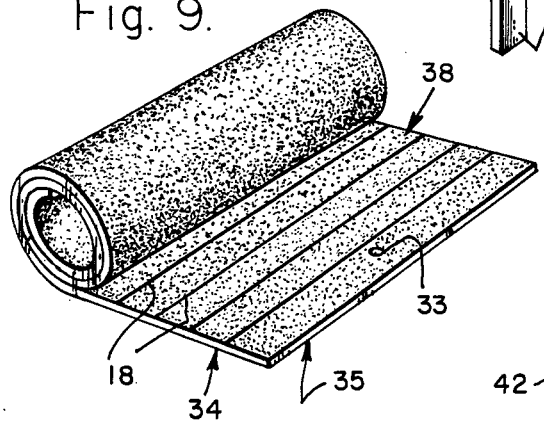
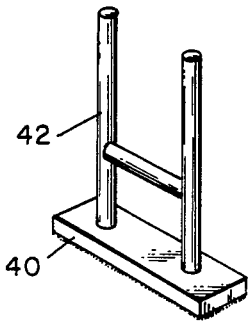
Fig. 10.

FINGER FOOTBALL/FINGER RUGBY GAME

This is a continuation-in-part of parent case Ser. No. 06/812,078, filed 12-23-85, and since abandoned.

BACKGROUND OF THE INVENTION

1. Field of the Invention

This invention relates generally to table top games for being played competitively between players 2. Description of Prior Art It is well known that many games played by teams of players on large out-of-door fields have been miniaturized so that one or two players can play a simulation of the game at home, such as upon a table top. This has occurred for games such as baseball, tennis, hockey, football and the like.

In a conventional children's table top game of "football," the football is made by folding paper into a triangle; goal posts are made with the player's fingers; and touchdowns are scored when the paper triangle hangs over the edge of the table without falling off. It is now believed that such playing elements of this game can be improved for greater enjoyment.

SUMMARY OF THE INVENTION

Accordingly, it is a principal object of the present invention to provide a game wherein the playing field and ball will be standardized, allowing consistency thereof throughout the country. Rules will be made easy to follow, and will be provided with each purchase of a set of the game. The playing field will be "chalked" on both sides; one for "Finger Football" and the other for "Finger Rugby."

Other objects are to provide a Finger Football/Finger Rugby game which is simple in design, inexpensive to manufacture and to purchase, and which gives a pleasant diversion to players of all ages.

These and other objects will be readily evident upon a study of the following specification and the accompanying drawing.

BRIEF DESCRIPTION OF THE DRAWINGS

FIG. 1 is a perspective view of a Finger Football-/Rugby game device shown in accordance with the present invention;

FIG. 2 is a top plan view of the rugby field showing line divisions;

FIG. 3 is a top plan view of the opposite side of the game board showing a football field and its line divisions;

FIG. 4 is a top plan view of a rugby ball used in playing the rugby game;

FIG. 5 is a top plan view of a football used in the football game;

FIG. 6 is a perspective view of the player using a finger kicker for the conversion scoring of the game;

FIG. 7 is an exploded view of FIG. 1 more fully illustrating the reversible game board;

FIG. 8 is a partial view illustrating the removable goal post used in both games;

FIG. 9 illustrates a flexible game board having different games on each side; and FIG. 10 illustrates free standing goal posts capable of being used on the reversible fixed board of FIG. 1 or the flexible reversible board of FIG. 9.

DETAILED DESCRIPTION

Referring now to the drawing in greater detail, the reference numeral 10 represents a Finger Football/Finger Rugby game, according to the present invention, wherein there is shown a reversible playing table surface 11 that is invertibly placeable upon a table 12 comprised of a table top 13 mounted fixedly upon table legs 14 for standing on a floor.

The reversible playing table surface is made with a different playing field on each opposite side thereof, and comprises a rugby playing field 15 on one side and a football playing field 16 on the other. Each playing field is covered with a green colored indoor-outdoor carpeting material. The rugby playing field 15 is marked off with the line divisions 17 used in the actual game of rugby, while the football playing field 16 is marked off with the line divisions 18 used in the actual game of football. All the line divisions in both of the games may be identified by name or numeral upon the playing field. A removable raised goal post 19 is mounted upon each opposite end of the rugby playing field 15, and a removable raised goal post 20 may be likewise mounted upon each opposite end of the football playing field 16.

The playing piece for the rugby game comprises a rugby ball 21 while for the football game it comprises a football 22. The playing pieces are made from nerf-type rubber or plastic material, being generally oval shaped, and the rugby ball 21 having flattened opposite ends. In playing the games, the balls are held against the table top by a finger 23 of one hand and "kicked off" by an index finger 24 of the other hand.

While the present invention is not limited to specific sizes, the following dimensions are suggested for a practical size of the game. The table top 13 measures approximately three feet by four feet. The rugby ball 21 measures one inch overall, and the football 22 is one and one-quarter inches overall.

The game device is also provided with an instruction leaflet or booklet (not shown) and which includes the playing and scoring rules for both of the games.

These playing and scoring rules are as follows:

1. Offense "kicks" the ball with a flick of the finger.
2. One attempt at goal per possession.
3. Scoring:
   a. Points:

| | | |
|---|---|---|
| TRY | ball lands in try area following offensive kick | 4 points |
| CONVERSION | direct kick through goal (after Try) | 2 points |
| DROP KICK | flat ball kicked through goal | 3 points |
| PENALTY KICK | upright ball kicked through goal | 3 points |

b. Ball must completely cross goal line or pass (on the fly) through goal posts to have points awarded.
4. Putting ball in play:
   a. At start of period: ball must lay flat and be punted out of try area.
   b. After crossing end line/through end-zone: place ball flat in zone adjacent to the area it went out, then punt.
   c. After crossing side line: a penalty is called and defense is awarded a direct kick at goal (within one inch of side line at spot where ball went out-of-bounds).

d. If touched before scoring or going out-of-play: penalty; offense is awarded a penalty kick from the conversion line center spot.

e. If not clearing half-distance line on a punt: penalty, defense may take a penalty kick at spot where the ball lays.

f. After Try: offense gets a direct conversion attempt from conversion line opposite spot where ball was downed in try area.

g. After point award: ball may be flat punted from anywhere out of end-zone.

5. Ball must be played as it lays on the field unless a penalty is called. In this case, the ball may be picked up and placed point first in the grass, then kicked at goal. This includes rebounds off goal uprights or crossbar—except conversion attempts.

6. An attempted penalty or drop kick which lands in the try area is scored as a Try (no matter whether the field goal was good or not).

1. Offense "kicks" the ball with a flick of the finger.

2. One attempt at goal per possession.

3. Scoring:

a. Points:

| | | |
|---|---|---|
| TOUCHDOWN | any part of the ball lands across goal line or in end zone | 6 points |
| PAT | point after touchdown from conversion spot | 1 point |
| SAFETY | failure to punt ball out of end zone | 2 points |
| FIELD GOAL | placed upright with finger hold and kicked thru goal posts | 3 points |

b. Ball must cross the goal line (any part) or pass (on the fly) thru goal posts to have points awarded.

4. Putting ball in play:

a. At start of period: ball must lay flat and be punted from your 40 yd. line.

b. After crossing end line/thru end zone: place ball flat in end zone adjacent to the area it went out, then punt.

c. After crossing side line: place ball flat on hash mark adjacent to side where it went out, then punt.

d. If touched before leaving the field: field goal attempt from 30 yd. line.

e. If not clearing your 40 yd. line on a punt: field goal attempt from the center of play closest to the ball's resting point.

f. After Touchdown: finger hold placement at conversion spot.

g. After point award: ball may be flat punted from anywhere out of end zone.

5. Ball must be played as it lays on the field unless attempting a field goal.

6. A field goal attempt which lands in the end zone is no score.

Referring now to FIG. 7, there is shown an exploded view illustrating in more detail how the reversible playing table surface 11 rests upon the table top in either the first position or the second position. In the first position, as shown, the rugby field 15 is exposed for use whereas reversing playing table surface exposes the football field 16 for use by players.

Referring now to FIG. 8, there is shown a more detailed view of the removable goal posts 19. In the preferred embodiment, goal posts 19 used for the rugby game and goal posts 20 used for the football game may both be constructed as described, thereby making all goal posts removable.

The posts 19 each contain an elongated spring 30 constructed of spring steel and connected at one end by means of a rivet 32 to the goal posts 19. Each goal posts 19 and 20 are constructed in a similar fashion whereby inserting the posts 19 or 20 into the appropriate opening 33 causes the spring 30 to be compressed, thereby frictionally engaging the posts 19 or 20 into the opening 33

The advantages of having removable goal posts allows the user to place the reversible playing table surface 11 on any suitable surface such as a card table, a pool table, a ping pong table, or even the floor itself, thereby eliminating the requirement of having a supporting table that is smaller than the reversible playing table surface 11.

Referring now to FIG. 9, there is shown a flexible reversible playing table surface 34 having the same indicia of a rugby field 35 on one side and a football field 38 on the reverse side. The advantages, of course, allow the user to store the game when not being used by simply rolling the flexible reversible playing table surface 34 into a suitable canister. The advantages of the game are maintained and transportation of the game from one room or from one building to another building is facilitated.

Referring now to FIG. 10, there are illustrated free standing goal posts consisting of a base 40 fixedly supporting goal posts 42.

The game would include two free standing goal posts for rugby and two free standing goal posts for football, thereby allowing the user the option of using the free standing goal posts when using the fixed reversible playing table surface 11 illustrated in FIG. 1 or when using the flexible reversible playing table surface 34 illustrated in FIG. 9.

While various changes may be made in the detail construction, it is understood that such changes will be within the spirit and scope of the present invention, as is defined by the appended claims.

We claim:

1. A finger football and finger rugby game device comprising:

a reversible table surface having a football playing field on one side and a rugby playing field on the opposite side, each of said playing fields comprising a green colored carpeting material having a plurality of transverse line divisions marked thereupon for use in playing a game, a pair of goal posts attached at each end of said reversible table surface, and a supporting table for holding said reversible table surface and in which the length of said supporting table is less than the length of said reversible table surface whereby the ends of said table surface and said goal posts mounted on said table surface extend beyond said supporting table.

* * * * *